US005518044A

United States Patent [19]

Ferguson

[11] Patent Number: 5,518,044

[45] Date of Patent: May 21, 1996

[54] FENCE CLIP WIRE TWISTER TOOL

[76] Inventor: Willie R. Ferguson, Rt. 2, Box 219, Bedford, Va. 24523

[21] Appl. No.: 302,187

[22] Filed: Sep. 8, 1994

[51] Int. Cl.[6] ..... B21F 3/00

[52] U.S. Cl. ..... 140/102.5; 140/118; 140/123

[58] Field of Search ..... 140/52, 57, 102.5, 140/106, 117, 118, 123; 7/108; 72/458, 479

[56] References Cited

U.S. PATENT DOCUMENTS

| | | | |
|---|---|---|---|
| 1,779,733 | 11/1929 | Hanbley | 140/117 |
| 2,824,475 | 2/1958 | Rolando | 140/123 |
| 3,722,256 | 3/1973 | Lascone | 140/123 |
| 3,805,854 | 4/1974 | Self | 140/117 |
| 4,074,732 | 2/1978 | Wilkens . | |
| 4,485,852 | 12/1984 | Frazier | 140/102.5 |
| 4,917,154 | 4/1990 | Roberson . | |
| 5,201,210 | 4/1993 | Stein, III | 140/123 |
| 5,309,954 | 5/1994 | Franssen . | |
| 5,335,701 | 8/1994 | Frazier | 140/57 |

*Primary Examiner*—Lowell A. Larson
*Assistant Examiner*—Ed. Tolan
*Attorney, Agent, or Firm*—Donavon Lee Favre

[57] ABSTRACT

A tool has a handle designed to be firmly held in one hand and a shaft having a tubular opening at the unattached end. The tool is used to attach fence wire to fence posts using a wire clip. The clip is hooked to a fence wire on one side of a post, the clip is then brought around the post and under the fence wire, the wire end protruding upward. The upwardly protruding wire end is then inserted into the tubular opening of the tool and wrapped around the fence wire. The procedure is repeated for the second wire end of the clip wire to firmly attach the fence wire to the fence post.

3 Claims, 3 Drawing Sheets

FENCE CLIP WIRE TWISTER TOOL

BACKGROUND OF THE INVENTION

Metal clip wires are employed to attach fence wire to fence posts. Upon positioning the fence wire against the post, each clip wire has one end fastened in a coil around the fence wire on one side of the post, then is drawn tightly away from the fence wire around the post, and the other end of the clip wire is coiled around the fence wire on the other side of the post. A tool such as a special pliers is used to coil the clip wire on both sides of the post to secure the clip wire in place.

An improved tool for fastening a clip wire to a fence wire is disclosed in U.S. Pat. No. 4,917,154 of Roberson (1990). The Roberson tool is a semi-flat tool having a slot to fit over a fence wire. Near the slot are a large number or holes positioned across the width of the tool. An end of a clip wire is inserted into an appropriate hole and the slot is positioned onto the fence wire. The gripping position on the Roberson tool is fixed by the position of the end of the clip wire relative to the position of the fence wire. Rotation of the tool coils the clip wire around the fence wire securing the fence wire to the fence post. The Roberson tool can also be used to tighten sagging metal wire, splice metal wire, removing old wire clips from posts and the general handling of metal wire.

A recent patent, U.S. Pat. No. 5,309,954 of Franssen (1994) is directed to a method for forming wire eyes. The tool used has a handle and a shaft. The shaft has a tubular opening at the end extending into shaft a selected distance corresponding to the length of wire needed to form an-initial bend in the wire. The end of the wire is inserted into the tubular opening and generally formed into a circular eye in two separate bending steps. A side opening is provided in the shaft adjacent the end to form a final bend in the wire to the wire eye which may be forcefully closed by a pliers or the like. U.S. Pat. No. 4,074,732 of Wilkens (1978) discloses a unitary multi-purpose tool that cuts, strips and twists together wires for example in preparation for the installation of insulating cap-type twist on wire connectors. The Wilkens tool consists of a handle and a coaxial head. A plurality of blind holes in the end of the head are adapted to insertion of the bared ends of two or more electrical conductors. A twist of the handle, while holding the unbared portion of the wires from turning, causes the bared ends to twist around each other into a helical bundle. Again, the tool is a special purpose tool without the remotest suggestion that it be used in the construction of wire fences.

SUMMARY OF THE INVENTION

Unlike the Roberson or Franssen tools, the gripping handle of the tool of the present invention can be positioned so that a forceful grip can be obtained for coiling the ends of the clip wire around the fence wire. Also the tool of the present invention does not require the side opening in the shaft required by Franssen to form eyes because the use of the tool of the present invention is totally different than of the Fanssen tool. The tool of the present invention also does not require the multiple holes in the end of the head as does the Wilkens tool because the tool of the present invention is designed for bending, not helical winding.

A fence wire tool of the present invention has an elongated shaft having a single tubular opening at one end of the shaft. The tubular opening extends coaxially to the length of the shaft into the shaft. The opening is sized for the insertion of an end of a piece of wire, such as a fence clip wire or a fence wire. A handle is positioned on the other end of the shaft for exerting force bending force on the piece of wire and wrapping the piece of wire around another piece of wire or a fence post.

In some instances, it is difficult to insert the end of a wire clip into the end of the open end of a straight shaft of the tool of the present invention. To accommodate such situations, one end portion of the shaft is bent at an angle of from 45° to 135° relative to the other end portion. Thus by having one tool with a straight shaft and a second tool with a shaft bent at an angle of from 45° to 135°, the end of any clip wire can be accessed and formed into a coil around a fence wire. The bent shaft tool of the present invention is particularly useful for attaching woven wire fence to fence posts where access through the fence is limited due to the small openings in the fence weave.

Also for a woven wire fence, rotation of the handle of the tool of the present invention is limited by the size of the openings in the fence weave. To reduce the circumference of rotation of the tool when attaching a wire clip it is preferred that the shaft of the tool extend from ¾ to 2 inches from the handle and that the handle have a length of from three to five inches. When the tool shaft is bent, the straight section of the shaft extends ½ to 1 inch from the handle.

The method for attaching a fence wire to a fence post uses a conventional attaching wire clip. The conventional steps of hooking one end of the wire clip to the fence wire on one side of the fence post and extending the wire clip around the fence post to the extent that the other end of the wire clip extends beyond the fence wire on the other side of the fence post are employed. The inventive steps include inserting the other end of the wire clip into an end opening of a tubular shaft of a hand tool and bending the other end of the wire clip around the fence wire to the extent that the wire clip remains in place and the fence wire is attached to the fence post.

The tool of the present invention can also be employed to splice fence wire or to attach fence wire to a fence post. The method for attaching a first wire to another wire or a fence post comprises inserting an end of the first wire into an end opening of a tubular shaft of a hand tool and retaining the other wire or fence post in a stationary position while bending the end of the first wire around the other wire or fence post to the extent that the first wire remains attached to the second wire or fence post. To complete the splice the procedure can be repeated on and end of the second wire.

The first wire can be bent at least 180°, preferably at least 360° and more preferably at least 720°. Corresponding bending or coiling can also be employed on an end of the second wire if a splice is contemplated. If a splice is not contemplated, coiling the end of the first wire around a running length of a second wire completes the attachment.

DETAILED DESCRIPTION

Figure 1:
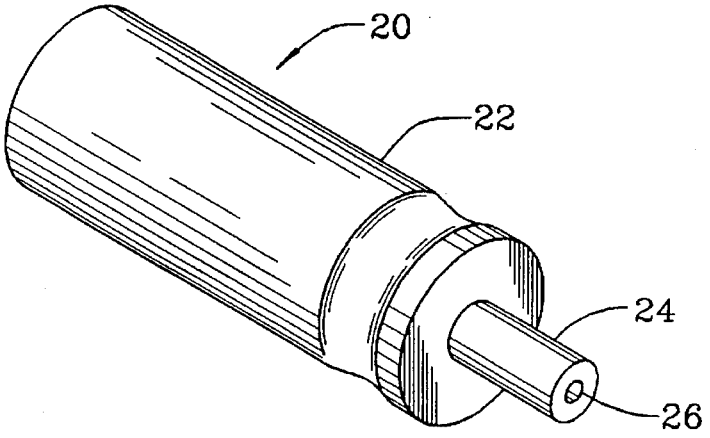
FIG. 1 is a perspective view of an embodiment of the clip wire bending tool having a straight shaft.

The primary embodiment of the hand tool of this invention is generally designated by the reference numeral 20 in FIGS. 1, 4, 5, 6, and 7. The tool 20 is made from a handle 22 and a shaft 24. The handle is about 4 inches long and an inch and a half in diameter. The shaft 24 has a diameter of about 3/16th of an inch and extends from the handle 22 about an inch and a quarter. The shaft 24 has a tubular opening 26 extending into the shaft for the insertion of an end 28 or 30 of clip wire 32 (see FIG. 4). Clip wire 32 has a diameter of approximately 1/16th of an inch and the tubular opening 26 has a diameter of approximately 3/32nds of an inch to accommodate the clip wire 32. Preferrably the opening 26 extends an inch into the shaft.

Figure 2:
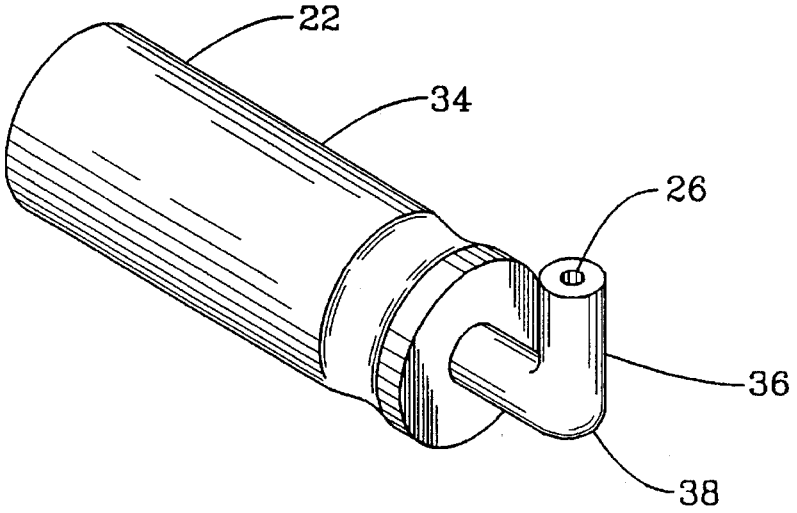
FIG. 2 is a perspective view of an embodiment of the clip wire bending tool having a shaft bent at 90°.
Figure 3:
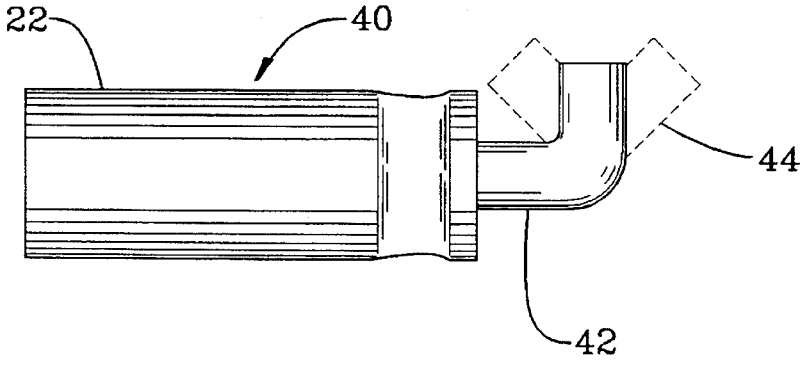
FIG. 3 is a perspective view of an embodiment of the clip wire bending tool having a shaft bent at an angle of from 45° to 135°.

When an end 28 or 30 of clip wire 32 is inaccessible with tool 20 a modified tool of the configurations shown in FIGS. 2 and 3 can be used. The tool of FIG. 2 is generally designated by the reference numeral 34. The tool 34 has the same design handle 22 as tool 20. The shaft 36 of tool 34 is bent at a 90° angle 38. This 90° angle 38 allows easier access to clip ends 28 and 30 when the clip ends are on the opposite side of a fence and pointed away from the person attaching the clips. This is particularly true for a woven fence where access to the clip ends is limited.

A modification of tool 34 is shown in FIG. 3 as tool 40. Tool 40 is identical in design to tool 34 except for the angle of the bend in the shaft. The shaft 42 of tool 40 is bent at an angle of from 45° to 135° shown in dashed lines at 44. This 45° to 135° angle 44 in the shaft can be useful in situations where a straight shaft 24 does not allow easy access to clip ends 28 and 30.

Figure 4:
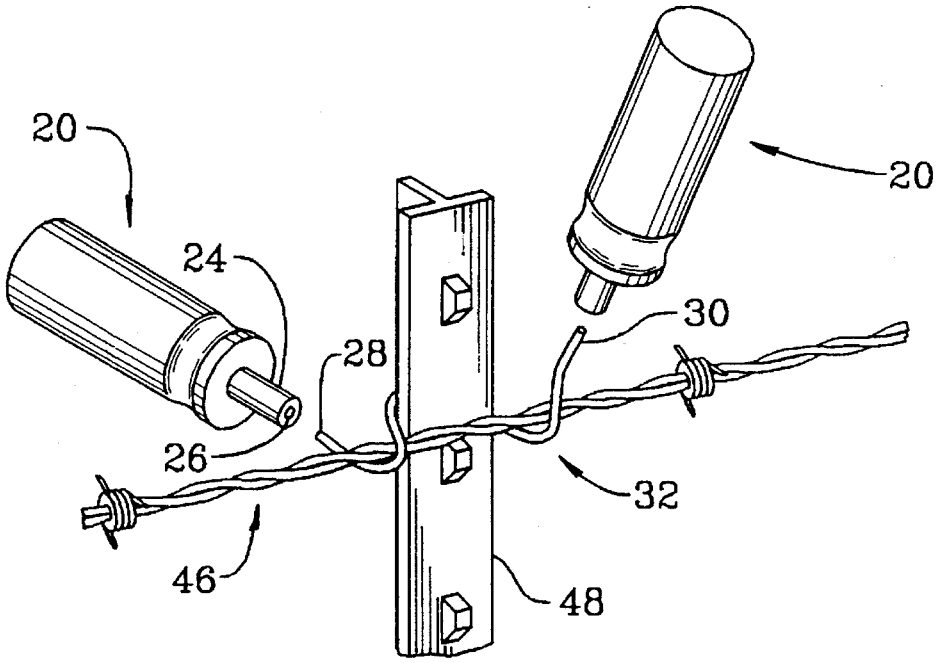
FIG. 4 shows the positioning of the tool at the ends of a clip wire to attach a fence wire to a fence post.
Figure 5:
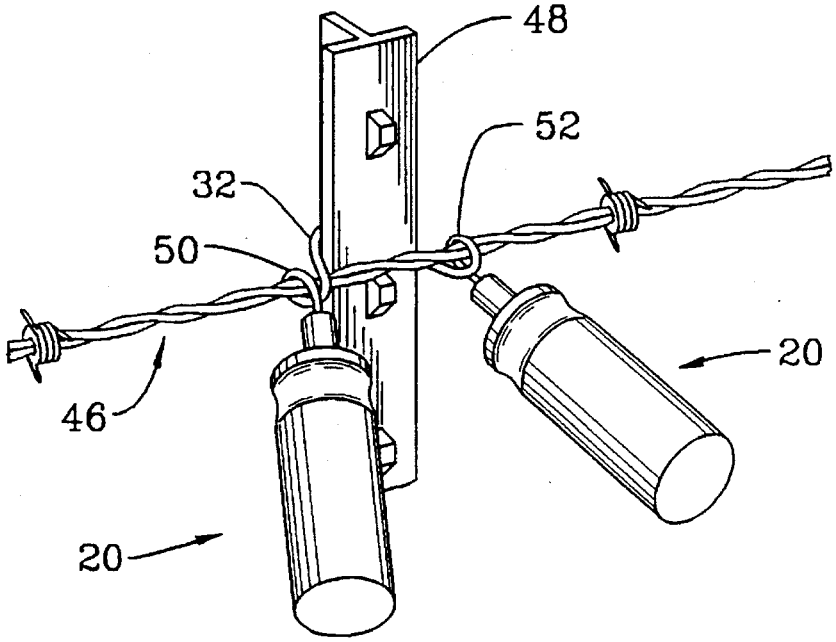
FIG. 5 shows the bending of the clip wire to attach the fence wire to the fence post.

Turning now to FIGS. 4 and 5, the method of use of the tool of the present invention is shown. A clip 32 is hooked around fence wire 46 brought around fence post 48 and up under the fence wire 46 on the other side of fence post 48. The shaft 24 of tool 20 is then placed around clip end 28, the clip end 28 entering tubular opening 26. Tool 20 is then rotated around fence wire 46 forming a wrapped wire attachment 50 of clip 32 to fence wire 46. The same procedure is followed on the other side of post 48 with clip end 30 to form attachment 52. With the formation of attachment 52, the fence wire 46 becomes attached to fence post 48.

Figure 6:
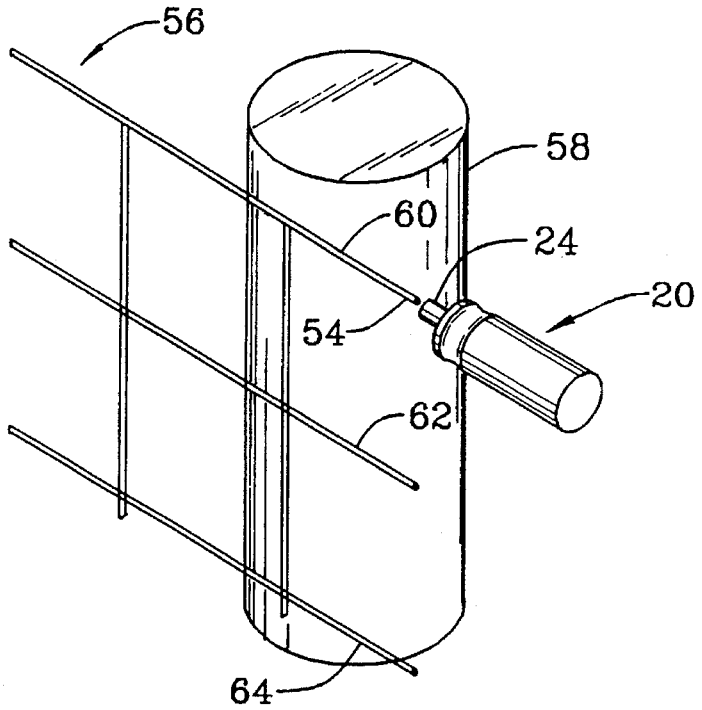
FIG. 6 shows the positioning of the tool to bend a woven fence wire around a round fence post.

The tool of the present invention can also be used to attach a woven wire fence to a fence post as is shown in FIG. 6. The shaft 24 of tool 20 is placed around wire end 54 of woven wire fence 56, the wire end 54 positioned inside of tubular opening 26. The tool 20 is then rotated around fence post 58 to bend the wire 60 around fence post 58 to hold wire 60 in place. The process is repeated with wires 62, 64 and the remaining wires of the woven wire fence.

Figure 7:
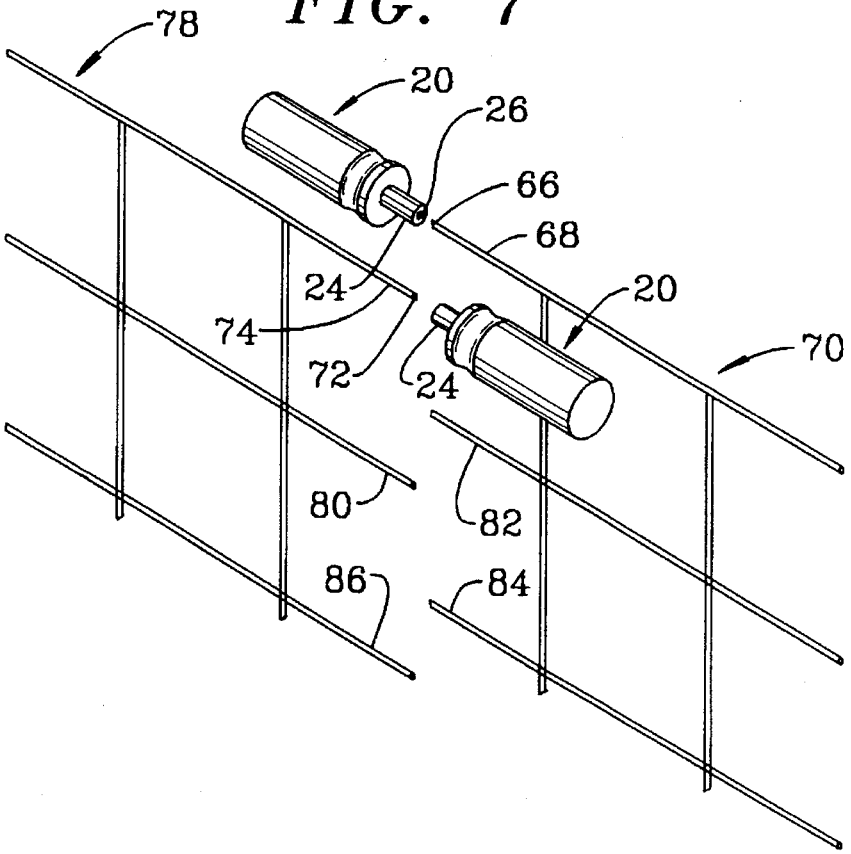
FIG. 7 shows the positioning of the tool preparatory to splicing the wires of a woven fence.

The tool of the present invention can also be used to splice fence wires as is shown in FIG. 7. The shaft 24 of tool 20 is placed around wire end 66 of fence wire 68 of woven fence 70 the wire end 66 positioned inside of tubular opening 26. The shaft 24 of a second tool 20 is placed around wire end 72 of fence wire 74 of woven wire fence 78, the wire end 72 positioned inside of tubular opening 26. Tools 20 are then used to bend wires 68 and 74 into U shapes, wire 68 being in the bend of wire 74 and wire 74 being in the bend of wire 68. Wire 68 is then wrapped around itself as is wire 74. The process is repeated for wires 80 and 82 and wires 84 and 86.

What is claimed is:

1. A fence wire tool consisting essentially of an elongated tubular shaft, a single round opening at one end or the shaft which round opening extends coaxially into the shaft for the insertion of an end of a piece of wire, and a handle on the other end of the shaft for exerting force and wrapping the piece of wire around another piece of wire or a fence post, wherein the one end of the shaft is bent at an angle of from 45° to 135° relative to an opposing end portion.

2. The tool of claim 1 wherein the one end portion of the shaft is bent at an angle of 90° relative to the opposing end portion.

3. A combination of fence wire clip twisting tools capable of accessing the end of any clip wire comprising a first tool consisting essentially of a straight elongated tubular shaft, a single round opening at one end of the shaft which round opening extends coaxially into the shaft for the insertion of an end of a piece of wire, and a handle on the other end of the shaft for exerting force and wrapping the piece of wire around another piece of wire or a fence post in combination with a fence wire tool consisting essentially of an elongated bent tubular shaft, a single round opening at one end of the shaft which round opening extends coaxially into the shaft for the insertion of an end of a piece of wire, and a handle on the other end of the shaft for exerting force and wrapping the piece of wire around another piece of wire or a fence post, wherein the one end of the shaft is bent at an angle of from 45° to 135° relative to an opposing end portion.

* * * * *